United States Patent [19]

Greer

[11] Patent Number: 4,512,377

[45] Date of Patent: Apr. 23, 1985

[54] BEVERAGE DISPENSING APPARATUS

[76] Inventor: Terry N. Greer, 3237 Scruggs Park Dr., Richland Hills, Tex. 76118

[21] Appl. No.: 563,295

[22] Filed: Dec. 19, 1983

[51] Int. Cl.[3] ..... B67D 5/02

[52] U.S. Cl. ..... 141/11; 222/129; 222/135

[58] Field of Search ..... 62/338, 339; 141/11, 141/82, 242, 243; 222/504, 129, 129.1, 135

[56] References Cited

U.S. PATENT DOCUMENTS

| | | | |
|---|---|---|---|
| 340,377 | 4/1886 | Shomate | 62/339 |
| 1,811,234 | 6/1931 | Hicks, Jr. et al. | 62/339 X |
| 2,076,922 | 4/1937 | Simard | 62/338 |
| 2,164,714 | 7/1939 | Kornblatt | 62/339 X |
| 2,294,119 | 8/1942 | Leary | 62/338 X |
| 2,327,910 | 8/1943 | Levine | 62/338 X |
| 3,221,936 | 12/1965 | Spinuzza | 222/504 X |
| 3,380,629 | 4/1968 | Kontra et al. | 222/504 X |
| 4,334,640 | 6/1982 | van Overbraggen et al. | 251/5 X |

*Primary Examiner*—Stephen Marcus
*Assistant Examiner*—Mark Thronson
*Attorney, Agent, or Firm*—Charles D. Gunter, Jr.

[57] ABSTRACT

A beverage dispensing apparatus is shown for filling multiple containers at a beverage dispensing station located adjacent a walk-in beverage cooler. A housing is mounted on an upright exterior wall of the walk-in cooler. The housing has top, bottom and interconnecting side walls. One of the side walls is mounted flush with the cooler upright wall and is provided with a wall duct which communicates with the interior of the walk-in cooler. The bottom wall of the housing is provided with beverage dispensing openings which are selectively positioned for dispensing beverages into a plurality of containers located below the bottom wall. A plurality of transfer lines are connected at one end to a source of pressurized beverage inside the walk-in cooler. The opposite ends of the lines pass through the wall duct into the housing and run to the beverage dispensing openings for dispensing beverage into the containers located below the bottom wall. Pinch valves located within the housing control the simultaneous flow of beverage through the lines to the dispensing openings. A blower mounted on the interior upright wall of the walk-in cooler opposite the housing circulates cool air from within the walk-in cooler, through the wall duct, and into the interior of the housing to cool the beverage being transferred through the beverage transfer lines.

9 Claims, 3 Drawing Figures

BEVERAGE DISPENSING APPARATUS

BACKGROUND OF THE INVENTION

1. Field of the Invention

This invention relates to beverage dispensing systems and, more specifically, to a beer dispensing apparatus for simultaneously filling multiple containers in a high volume beer dispensing system.

2. Description of the Prior Art

High volume beer dispensing systems are needed in such areas as sports stadiums and arenas where it is necessary to provide beer to large numbers of people in a short period of time. Paper cups or similar containers are preferred since such containers cannot be broken or cause injury if thrown. For this reason, beer is generally dispensed at a concession area in light-weight drinking containers such as plastic or paper cups.

One advantage of dispensing beer into cups instead of serving bottled beer is that the beer can be tapped directly from the keg. Many persons prefer the taste of beer dispensed in this manner over that of beer which is bottled or tinned. However, when light-weight cups or containers are utilized, several problems exist in pouring beer quickly into large numbers of containers. For instance, it is known that when beer is poured slowly into a container, it generally pours flat, without any head. When beer is poured fast, on the other hand, a large head will form and only a portion of the container will be filled with beer.

It is not unreasonable to estimate that a concessionaire in a modern sports stadium could face the prospect of serving ten to twenty thousand people during a two to three hour sporting event. The concessionaire might therefore face the demand of pouring five to ten thousand beers per hour by a conservative estimate. The problem then is to pour fast enough during short time periods to meet the customer demand and yet control the tendency of the beer to form a head when it is poured rapidly.

It has been found that beer can be dispensed into containers without causing excessive foaming if the beer temperature is maintained sufficiently close to its freezing temperature while being transferred to the container. Since the freezing temperature for most beers is in the neighborhood of 28° F., the beer must be maintained below about 35°–40° F. and preferably at an even cooler temperature while being dispensed. U.S. Pat. No. 4,011,896 to Nilon et al, issued Mar. 15, 1977, shows a beer dispensing system which utilizes beer dispensing lines which are cooled by a heat exchange system to depress the temperature of the beer in the dispensing lines. U.S. Pat. No. 4,094,445, to Bevan, issued June 13, 1978, shows a beer dispensing system for rapidly filling multiple containers in which a coolant is circulated around the beer in the beer supply line and in the dispenser for cooling the beer. Since these systems utilize an independent refrigeration system for maintaining and circulating coolant about the beer dispensing lines, they are extremely expensive to manufacture and greatly increase the cost of the concession operation.

There exists a need, therefore, for a beer dispensing system which is inexpensive in design and simple to manufacture.

There exists a need for such a system which can be used to fill multiple containers in a short time period without excessive beer foaming.

There exists a need for such a system which can be used to dispense beer directly from the keg for improved beer flavor.

SUMMARY OF THE INVENTION

The beer dispensing apparatus of the invention is used for filling multiple containers at a beverage dispensing station located adjacent a walk-in beverage cooler. The apparatus includes a housing which is mounted on an upright wall of the associated walk-in cooler. The housing has top, bottom and interconnecting side walls. The bottom wall of the housing is provided with beverage dispensing openings and the openings are suitably positioned to dispense beverages into a plurality of containers which are located below the bottom wall, as on a drain table in a cup rack.

A plurality of beverage transfer lines are each connected at one end to a source of pressurized beverage inside the walk-in cooler. The opposite ends of the lines pass through an opening in the cooler wall and through an opening in the housing to the beverage dispensing openings for dispensing beverage into the containers located below the housing bottom wall. Valve means located within the housing control the simultaneous flow of beverage through the beverage transfer lines to the dispensing openings. A blower means, associated with the housing, circulates cool air from within the walk-in cooler into the interior of the housing to thereby cool the beverage being transferred through the beverage transfer lines.

The beverage transfer lines are preferably formed from a non-toxic flexible material and the valve means preferably includes a plurality of constriction or pinch type valves. Each of the valves is engageable with a selected one of the beverage transfer lines for pinching off the flow of beverage through the beverage transfer line. Since the apparatus utilizes the cool air of the walk-in cooler, no additional refrigeration is required. By utilizing beverage transfer lines formed from non-toxic, flexible material and constriction type valving, the beverage being dispensed is effectively isolated from machine contamination.

Additional objects, features and advantages will be apparent in the written description which follows.

DETAILED DESCRIPTION OF THE INVENTION

Figure 1:
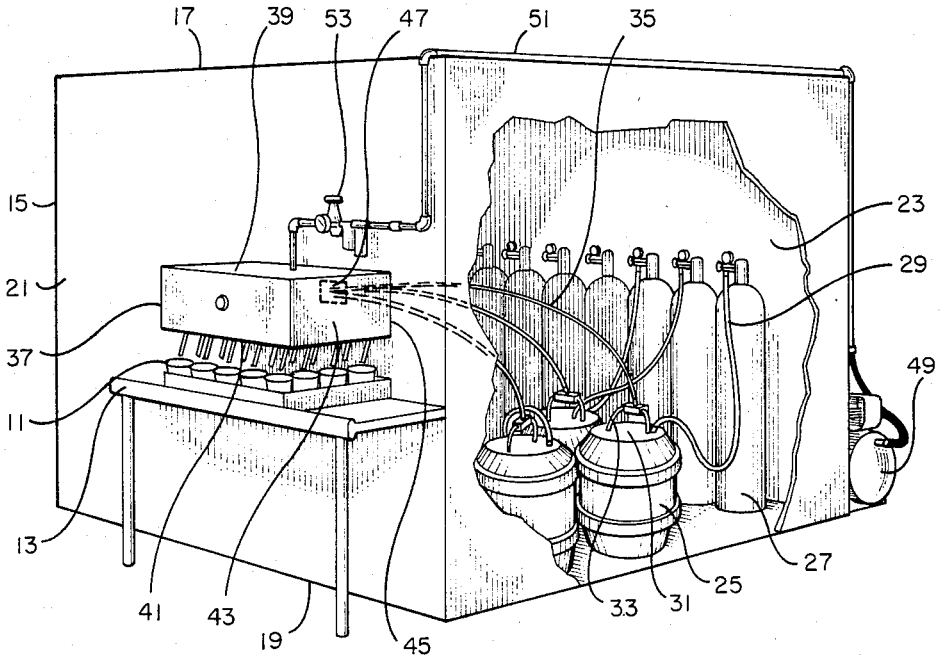
FIG. 1 is a perspective view of the beverage dispensing apparatus in place on an upright wall of a walk-in cooler, with portions of the cooler wall shown broken away.

FIG. 1 shows a beverage dispensing apparatus of the invention of the type used for filling multiple containers 11 at a beverage dispensing station 13 located adjacent a walk-in beverage cooler 15. The walk-in cooler is of conventional design having top and bottom walls 17, 19 and one or more connecting upright walls 21. A door (not shown) allows access to the interior 23 of the cooler 15 for storing one or more beverage bulk containers such as kegs 25. The cooler 15 is provided with a refrigeration system (not shown) for maintaining the interior temperature in the range of about 30°-40° F.

As shown in FIG. 1, the beer kegs 25 are pressurized by means of gas cylinders 27 which communicate pressurized gas through conduits 29 to the kegs 25. It should be understood, that although the cylinders 27 are shown within the interior 23 of the cooler 15 for ease of illustration, that the cylinders 27 could as easily be located on the exterior of the cooler 15.

The keg tops 31, as shown in FIG. 1, have outlet lines 33 connected thereto which communicate by means of conduits 35 with a beverage dispensing housing 37. The housing 37 is a generally rectangular box of sheet metal which is adapted to be mounted on the exterior surface of the upright wall 21 of the cooler 15. The housing 37 has top and bottom walls 39, 41 and interconnecting side walls 43. A rear side wall 45 of the housing is mounted flush with the cooler upright wall 21 and includes a wall duct 47 (shown in dotted lines in FIG. 1) which is aligned with a similar opening provided in the upright wall 21 of the cooler 15. An air compressor 49 is located on the exterior of the cooler 15 and supplies gas pressure through a supply line 51 and through conventional filters and regulators 53 to the housing 37.

Figure 3:
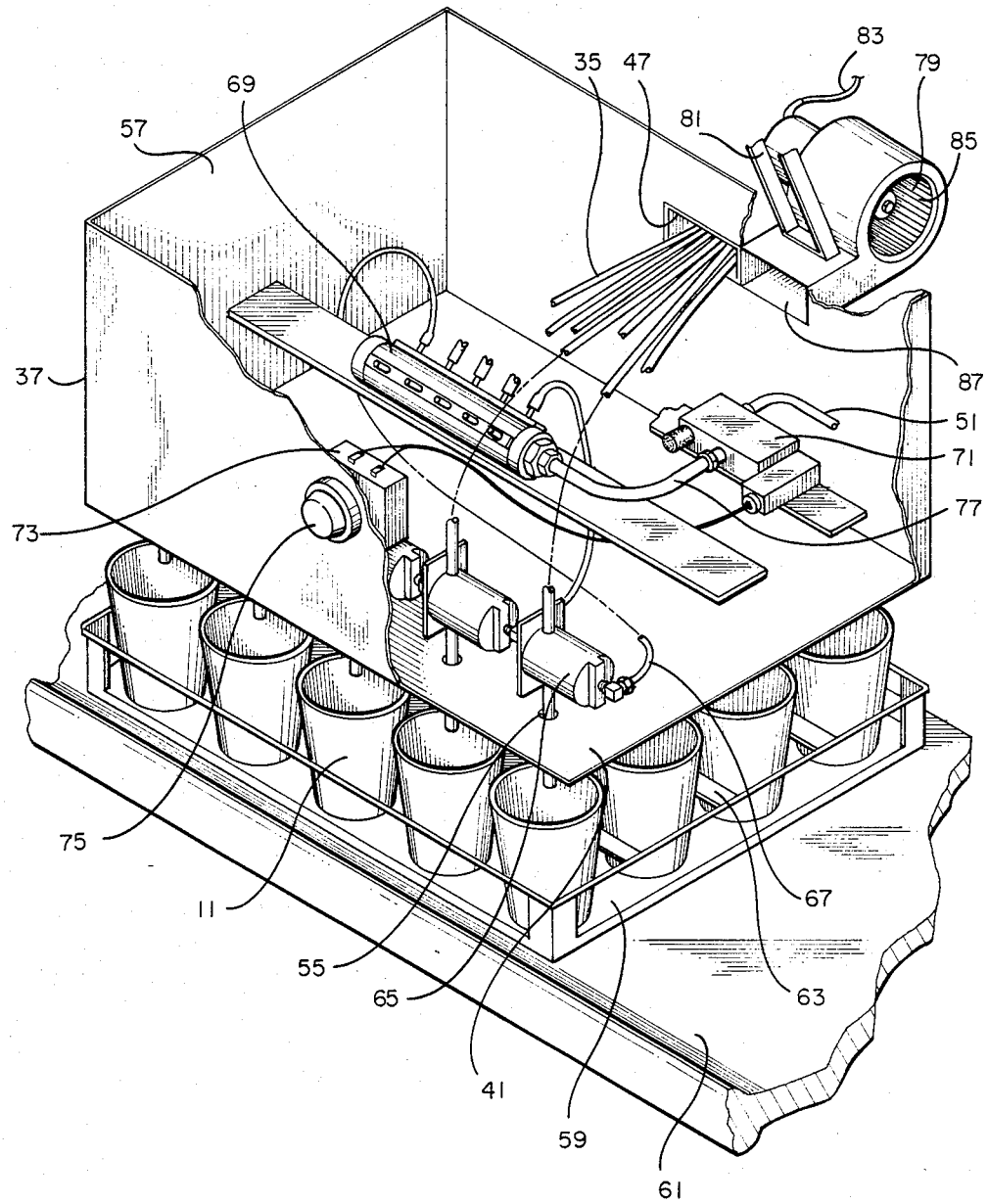
FIG. 3 is a close-up perspective view of the dispensing apparatus of FIG. 1, with portions broken away for ease of illustration.

As shown in FIG. 3, the housing bottom wall 41 is provided with beverage dispensing openings 55, the openings 55 being selectively positioned for dispensing beverages into a plurality of containers 11 located below the bottom wall 41. The conduits (35 in FIG. 1) passing from the beer kegs 25 pass through the wall duct 47 into the housing interior 57 and run to the beverage dispensing openings 55. The conduits 35 thus comprise beverage transfer lines for dispensing beverages through the dispensing openings 55. Although the conduits 35 are shown in FIG. 3 to run directly through the openings, it should be understood that suitable nozzles or guides could be provided for orienting the direction of the fluid being dispensed. In this case, the beer is being dispensed into a plurality of containers 11 which are located below the bottom wall 41 and which are carried in a beverage tray 59 on a drain table 61. The cups are oriented in rows by racks 63 in the beverage tray 59. The number and location of the cups 11 are selected to correspond to the number and location of dispensing openings 55 in the housing 37 which are being operated to dispense beverage from the housing. FIG. 3 has been simplified for ease of illustration, but it should be understood that in practice the number of dispensing openings 55 will generally correspond to the number of containers being filled.

The beverage transfer lines 35 are preferably formed from a flexible, non-toxic material such as synthetic plastic in order to insure the integrity of the beverage being dispensed. Valve means, such as the pinch valves 65 are located within the housing 37 for controlling the simultaneous flow of beverage through the beverage transfer lines 35 and to the containers 11. The pinch valves 65 are commercially available constriction type valves which are pneumatically operated by gas pressure supplied through pilot lines 67. By "constriction" valve is meant that the transfer lines 35 are compressed by the pinch valves 65 to squeeze off flow depending upon the pilot signal sent through the line 67. A suitable valve is available from Airmatic-Allied, Inc. of 185 Park Drive, Wilmington, Ohio, as the "O series, type 206" valve. Because the beverage being dispensed is isolated from contact with the valve parts, the possibility of contaminating the beverage is eliminated.

The pinch valves 65 are pneumatically operated from a gas manifold 69 located within the housing 37. Each of the pinch valves 65 is connected to the gas manifold 69 by a fluid conduit such as pilot lines 67. The manifold 69 is connected, in turn, to the supply line 51 leading from the air compressor 49 (FIG. 1).

An electrically operated solenoid valve 71 located within the housing 37 is connected within the gas supply line 51 for controlling the flow of gas to the manifold 69 to thereby control the flow of gas through the pilot lines 67 leading to the pinch valves 65 for opening and closing the valves 65. Switch means, such as an electrical switch 73 is provided for controlling the flow of electrical current from an electrical source, such as a conventional wall outlet (not shown), to the electrically operated solenoid 71. A button 75 on the exterior wall of housing 37 is used to switch the solenoid 71 by pressing the button 75.

Figure 2:
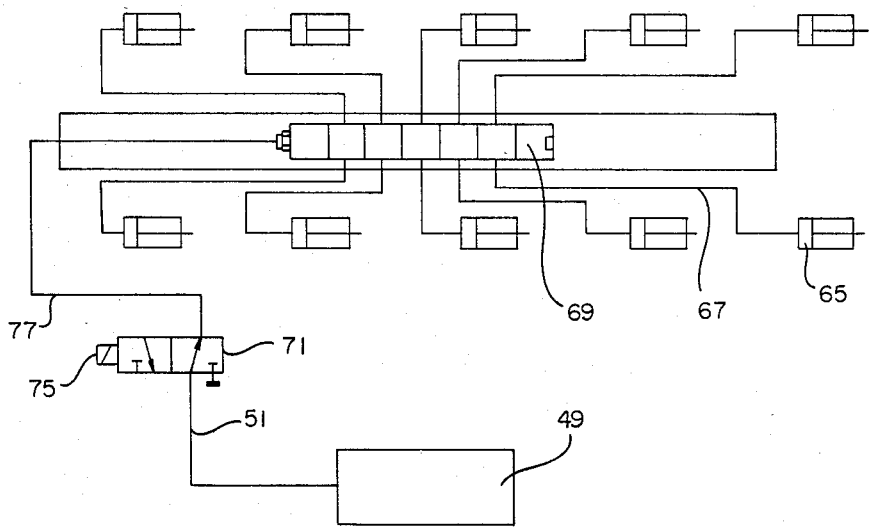
FIG. 2 is a schematic view of the operation of the valve system of the apparatus of FIG. 1.

The operation of the valve system is illustrated in the simplified schematic shown in FIG. 2. Gas pressure from the compressor 49 passes through the supply line 51 to the solenoid 71. The electrical switch 73 (FIG. 3) and position of the button 75 control the flow of gas through the outlet line 77. In the position shown, a continuous supply of air passes through line 77 and through manifold 69 and pilot lines 67 to the pinch valves 65. In the known manner, a cylinder within the pinch valve 65 is actuated to compress or squeeze off the flow of beverage through the beverage dispensing lines 35 (FIG. 3).

When the concessionaire desires to dispense beverage, the button 75 is pressed, moving the solenoid 71 to the right as shown in FIG. 2. The gas pressure from compressor 49 is then shut off and pressure in outlet line 77 is allowed to drain backwardly and be vented. The release of pressure at the pinch valves 65 eases the constriction of the beverage transfer lines 35, thereby allowing beverage to be simultaneously dispensed to multiple cups 11. The button 75 can be spring loaded and held down to fill the cups 11 to the desired level. Preferably, the solenoid 71 can be provided with a timing circuit which dispenses a predetermined amount of beverage before the switch (71 in FIG. 2) reverses to again supply gas pressure to the pinch valves and close off flow.

The housing 37, as shown in FIG. 3, is also provided with a blower means, such as an impeller blower 79 for circulating cool air from within the interior 23 of the walk-in cooler 15 into the interior of the housing 57 to thereby cool the beverage being transferred through the beverage transfer lines 35. The impeller blower 79 can be conveniently mounted, as by brackets 81 on the interior upright wall of the walk-in cooler 15 immediately behind the housing 37. The impeller blower 79 is electrically powered from a power line 83 and draws cool air through an inlet duct 85 and dispenses cool air through an outlet duct 87 to the housing interior 57. Although the beverage transfer lines 35 and blower 87 are both arranged to communicate through the housing wall duct 47 in FIG. 3, other duct arrangements could be provided as well.

An invention has been provided with several advantages. Because the apparatus housing is mounted flush with a walk-in cooler wall, the cool air from the interior of the cooler can be utilized to maintain the beer in the dispensing lines at the desired temperature. The elimination of additional refrigeration systems greatly reduces the cost of the dispensing apparatus. The apparatus utilizes non-toxic tubing to directly tap the beer keg located inside the cooler and a unique valving system which isolates the valve parts from the tubing to insure that the beverage being dispensed is not contaminated. The dispensing apparatus of the invention allows multiple beverage containers to be filled quickly and efficiently without foaming of the beverage being dispensed.

A greater or lessor number of valves can be actuated during any serving cycle, as by disconnecting the pilot lines, to meet the given requirements of the concessionaire. An uninterrupted beverage dispensing line runs from a beverage container in the cooler to a single beverage dispensing opening in the housing. Since each dispensing opening has its own line and pinch valve, one type of beverage could be used to fill certain of the containers on the tray while another type of beverage is used to fill others of the containers on the tray. The absence of a common fluid manifold also lessens the tendency of beer to foam during the dispensing operation.

While the invention has been shown in only one of its forms, it is not thus limited but is susceptible to various changes and modifications without departing from the spirit thereof.

I claim:

1. A beverage dispensing apparatus for filling multiple containers in a high volume beverage dispensing operation, comprising:

a walk-in beverage cooler having a refrigerated interior enclosed by upright walls, a floor and a ceiling;

a housing mounted directly onto an upright wall of said walk-in cooler, said housing having top, bottom and interconnecting side walls, and said bottom wall being provided with beverage dispensing openings, said openings being selectively positioned for dispensing beverages into a plurality of containers located below said bottom wall, one of said housing side walls being provided with a wall duct which is aligned with an opening provided in said walk-in cooler upright wall;

a plurality of beverage transfer lines, each of said lines being connected at one end to a source of pressurized beverage inside said cooler to be dispensed, the opposite ends of said lines passing through said wall duct directly into said housing and running to said beverage dispensing openings for dispensing beverage into said containers located below said bottom wall; and valve means located within said housing for controlling the simultaneous flow of beverage through said beverage transfer lines to said dispensing openings.

2. A beverage dispensing apparatus for filling multiple containers in a high volume beverage dispensing operation, comprising:

a walk-in beverage cooler having a refrigerated interior enclosed by upright walls, a floor and a ceiling;

a housing mounted directly onto and flush with an upright wall of said walk-in cooler, said housing having top, bottom and interconnecting side walls, and said bottom wall being provided with beverage dispensing openings, said openings being selectively positioned for dispensing beverages into a plurality of containers located below said bottom wall one of said housing side walls provided with a wall duct which is aligned with an opening provided in said walk-in cooler upright wall;

a plurality of beverage transfer lines, each of said lines being connected at one end to a source of pressurized beverage inside said cooler to be dispensed, the opposite ends of said lines passing through said wall duct directly into said housing and running to said beverage dispensing openings for dispensing beverage into said containers located below said bottom wall;

valve means located within said housing for controlling the simultaneous flow of beverage through said beverage transfer lines to said dispensing openings; and blower means mounted on an interior upright wall of said cooler immediately behind said housing for circulating cool air from within said walk-in cooler through said wall duct into the interior of said housing to thereby cool the beverage being transferred through said beverage transfer lines.

3. The beverage dispensing apparatus of claim 2, wherein said beverage transfer lines are formed from a flexible material and wherein said valve means includes a plurality of pinch valves, each of said valves being engagable with a selected one of said beverage transfer lines for pinching off the flow of beverage through said beverage transfer lines.

4. The beverage dispensing apparatus of claim 3, wherein said beverage transfer lines are formed from a non-toxic, synthetic plastic material.

5. The beverage dispensing apparatus of claim 4, wherein said containers located below said bottom wall are carried within a beverage tray, said tray being located on a drain table located below said housing and adjacent said walk-in cooler wall.

6. The beverage dispensing apparatus of claim 5, wherein said containers comprise a plurality of cups carried in racks on said beverage tray, the number and location of said cups being selected to correspond to the number and location of dispensing openings being operated to dispense beverage from said housing.

7. The beverage dispensing apparatus of claim 3, wherein said pinch valves are pneumatically operated from a gas manifold located within said housing, each of said pinch valves being connected to said gas manifold by a fluid conduit and said manifold being connected, in turn, by a supply line to a supply of gas pressure.

8. The beverage dispensing apparatus of claim 7, further comprising:

an electrically operated solenoid valve connected within said gas supply line for controlling the flow of gas to said manifold to thereby control the flow of gas to said pinch valves for opening and closing said valves; and switch means for supplying electrical current to said electrically operated solenoid valve to open said valve and cause gas to flow to said manifold and, in turn, to said pinch valves to simultaneously operate said valves.

9. A method for simultaneously dispensing beverages to fill multiple containers in a high volume beverage dispensing operation, at a beverage dispensing station located adjacent a walk-in beverage cooler, comprising the steps of:

mounting a housing directly onto an upright wall of said walk-in cooler, said housing having a top, bottom and interconnecting side walls;

providing a wall duct in one of said housing side walls in alignment with a similar opening provided in said walk-in cooler upright wall;

providing beverage dispensing openings in said bottom wall of said housing, said dispensing openings being selectively positioned for dispensing beverages into a plurality of containers located below said bottom wall;

running a plurality of flexible beverage transfer lines from a source of pressurized beverage located within said walk-in cooler through said wall duct directly into said housing and to said beverage dispensing openings;

providing a valve means for each of said transfer lines within said housing for simultaneously controlling the flow of beverage through said dispensing openings;

cooling said transfer line portions located within said housing by circulating cool air from within said walk-in cooler to the interior of said housing; and dispensing beverages from a plurality of said dispensing openings to fill a plurality of containers located below said bottom wall.

* * * * *